US007861342B1

(12) United States Patent
Huang

(10) Patent No.: US 7,861,342 B1
(45) Date of Patent: Jan. 4, 2011

(54) MULTI-COMBINATIONAL SPRING MATTRESS

(76) Inventor: Yung-Lin Huang, No. 145. Fuxing Rd., Shulin City, Taipei County (TW)

( * ) Notice: Subject to any disclaimer, the term of this patent is extended or adjusted under 35 U.S.C. 154(b) by 0 days.

(21) Appl. No.: 12/814,065

(22) Filed: Jun. 11, 2010

(51) Int. Cl.
*A47C 27/15* (2006.01)

(52) U.S. Cl. ..... 5/716

(58) Field of Classification Search ..... 5/716, 5/720, 722, 727, 738
See application file for complete search history.

(56) References Cited

U.S. PATENT DOCUMENTS 1,528,066 A * 3/1925 McEntire ..... 5/722
6,990,701 B1 * 1/2006 Litvak ..... 5/723
7,757,322 B2 * 7/2010 An ..... 5/722

* cited by examiner

*Primary Examiner*—Fredrick Conley
(74) *Attorney, Agent, or Firm*—Rosenberg, Klein & Lee

(57) ABSTRACT

A multi-combinational spring mattress includes a frame portion for enclosing and defining a containing space, a bottom layer having a plurality of linear ditches longitudinally and latitudinally intersected at the top of the bottom layer, a plurality of lumps formed among the ditches, and the bottom layer being disposed at the bottom of the containing space, a plurality of spring layers, each having a plurality of individual spring cylinders and stacked onto the top of the bottom layer, a surface layer stacked onto the top of the spring layers, and a wrapping cover for completely wrapping the frame portion, the bottom layer, the spring layers and the surface layer in the wrapping cover, and the spring layers have elasticity coefficients, so that users can change the configuration of the spring mattress or replace any damaged or elastically fatigue spring layer easily.

4 Claims, 4 Drawing Sheets

MULTI-COMBINATIONAL SPRING MATTRESS

BACKGROUND OF THE INVENTION

1. Field of the Invention

The present invention generally relates to spring mattresses, and more particularly to a multi-combinational spring mattress that allows users to combine and swap internal spring layers to provide various different configurations of the mattress.

2. Description of the Related Art

Good sleeping quality allows people to enter into deep sleep, recover physical and mental strengths and maintain good health. Medical reports show that the time of deep sleep also affects one's physiological and metal conditions. For example, the intellectual development of a baby is affected by insufficient sleep. The sleeping time also affects memory power, and all of abovementioned problems are definitely related to a structural design of mattresses.

The structural design of mattresses should emphasize on balancing the pressure of a sleeper's body. Since a different pressure is exerted onto each part of the sleeper's body (including head, shoulder and back, etc) when the sleeper is lying in bed, a too-hard or too-soft mattress may cause discomfort or even pain to the sleeper, and a comfortable bed must be designed according to the user requirements. In FIG. 1, a conventional spring mattress 1 generally comprises a spring layer 11 having a liner 12 separately installed at top and bottom surfaces, and a cover 13 provided for covering the spring layer 11 completely and fixed to a combining position by sewing.

However, the interior of the aforementioned spring mattress 1 is a spring layer 11 having a single elasticity coefficient, and the elasticity coefficient cannot be adjusted according to each part of a sleeper's body when the sleeper is lying in bed. Furthermore, the cover 13 and the liner 12 will be aged or dirty to produce smells or bacteria. Since an opening of the cover 13 is sewed, users cannot remove the cover 13 or liner 12 to change or clean the cover 13 or the liner 12. Therefore, the users need a new spring mattress 1, but the spring layer 11 usually has a longer life span. Directly replacing the whole spring mattress 1 will be a waste and incompliance with the environmental protection requirements. In addition, the spring layer 11 is movably placed between the two liners 12, and thus the liner 12 and the spring layer 11 may be dislocated with respect to each other to affect the stability of their use, and springs of the spring layer 11 cannot return to their original positions after the dislocation of the springs takes place, and it may cause damages to the spring mattress 1.

In view of the foregoing drawbacks of the conventional spring mattress, the inventor of the present invention specially designed an installable/removable spring mattress structure with a design of a special bottom layer for positioning the spring layers to improve the stability and ventilation of the spring mattress effectively. The multi-combinational spring mattress is comprised of a plurality of spring layers with different elasticity coefficients, so that users can combine or swap the spring layers freely according to their needs.

SUMMARY OF THE INVENTION

Therefore, it is a primary objective of the present invention to overcome the aforementioned shortcoming and deficiency of the prior art by providing a multi-combinational spring mattress that allows users to swap or assemble a plurality of spring layers according to different user requirements and provides spring layers with different elasticity coefficients to correspond to different parts of a sleeper's body when the sleeper is lying in bed, and an easy way to replace a damaged or elastically fatigue spring layer.

To achieve the foregoing objective, the present invention provides a multi-combinational spring mattress, comprising: a frame portion, for enclosing and defining a containing space, a bottom layer having a plurality of linear ditches longitudinally and latitudinally intersected at the top of the bottom layer, a plurality of lumps formed among the ditches, and the bottom layer being disposed at the bottom of the containing space, a plurality of spring layers, each having a plurality of individual spring cylinders and stacked onto the top of the bottom layer, a surface layer stacked onto the top of the spring layers, and a wrapping cover for wrapping the frame portion, the bottom layer, the spring layers and the surface layer in the wrapping cover completely, wherein the spring layers have different elasticity coefficients, so that users can combine the spring layers of the mattress freely.

To maintain a clean spring mattress and provide an easy way of changing or swapping internal components of the spring mattress, an open portion is formed around the periphery of the top of the wrapping cover, and an engaging structure is installed at the open portion, wherein the engaging structure can be a zipper, a button or a Velcro tape.

The present invention provides an installable/removable spring mattress structure with a special bottom layer for positioning spring layers to improve the stability and ventilation of the spring mattress. The invention also adopts a plurality of spring layers with different elasticity coefficients, so that a user can combine and swap the spring layers according to the user's requirements and adjust the spring layers of different elasticity coefficients according to different parts of the user's body when the user is lying in bed. The invention also provides an easy way for changing a damaged or elastically fatigue spring layer or a dirty surface layer. In the meantime, the engaging structure (such as a zipper, a button or a Velcro tape) is installed at the open portion around the periphery of the wrapping cover to replace the conventional sewing method of fixing the wrapping cover, and provide an easy way of replacing a dirty or damaged surface layer, bottom layer or spring layer of the spring mattress.

DETAILED DESCRIPTION OF THE PREFERRED EMBODIMENTS

The technical characteristics of the present invention will become apparent with the detailed description of preferred embodiments and the illustration of related drawings as follows.

Figure 1:
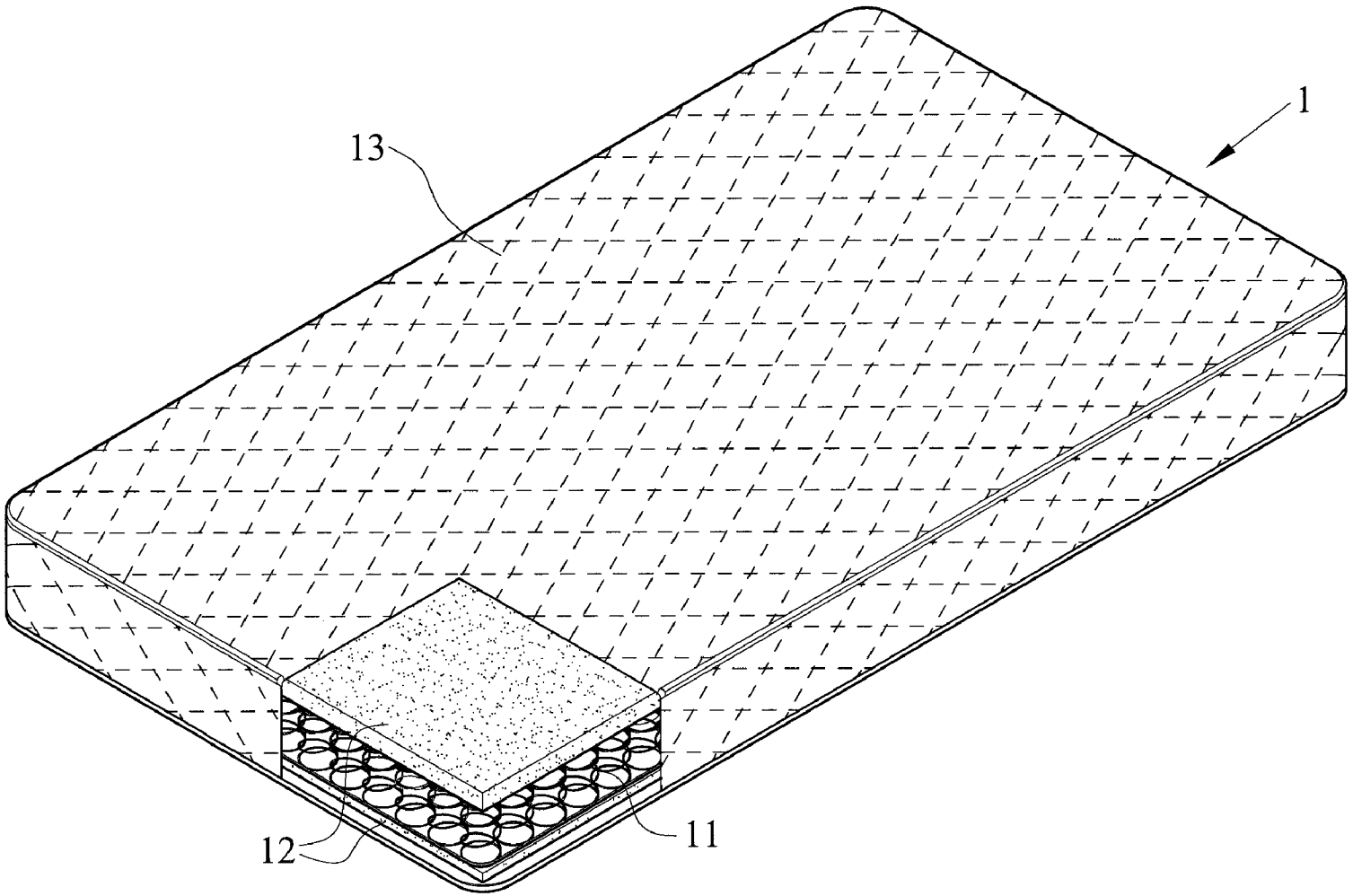
Fig.1(Prior Art)
FIG. 1 is a schematic view of a conventional spring bed structure.
Figure 2:
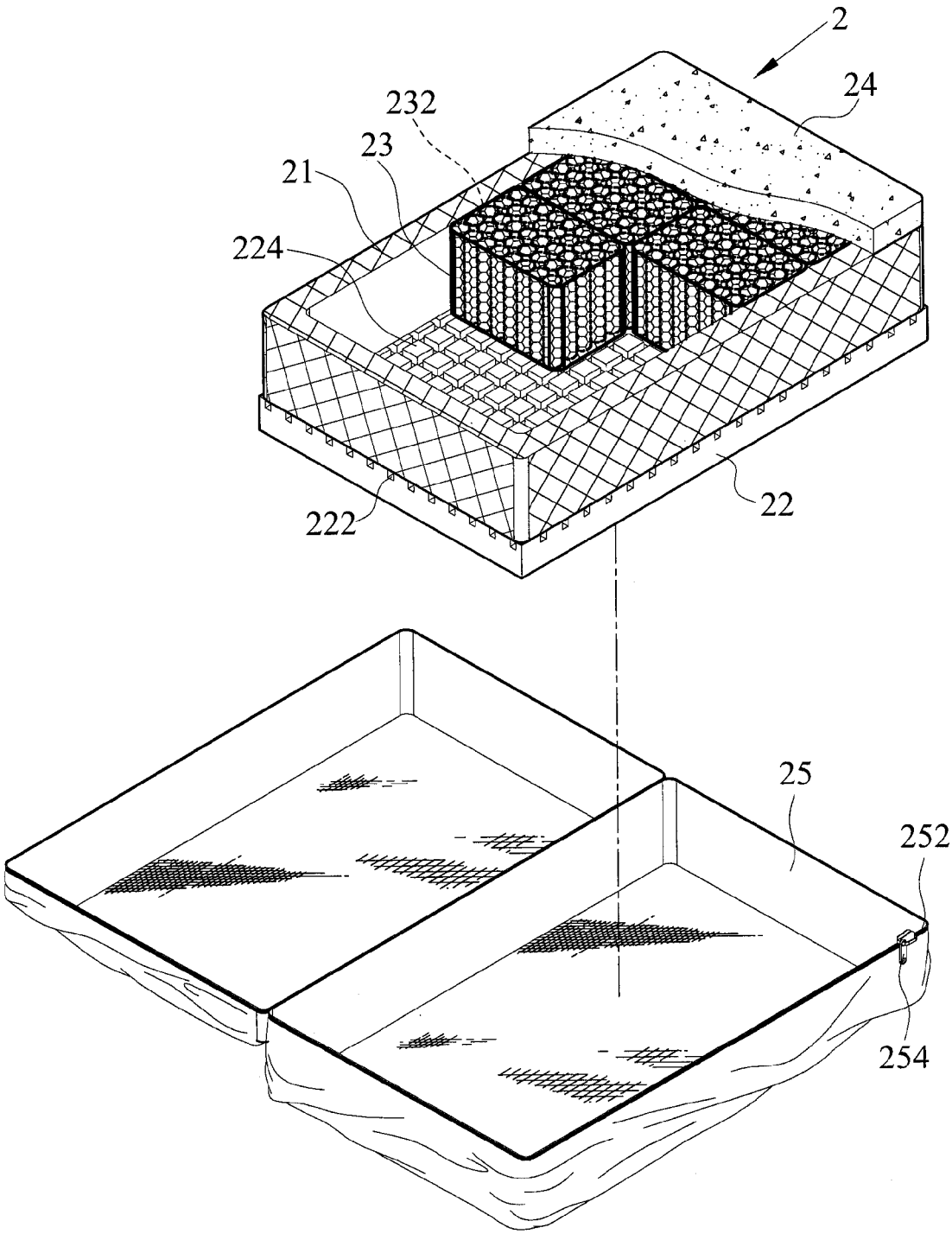
FIG. 2 is a cross-sectional view of a preferred embodiment of the present invention.
Figure 3:
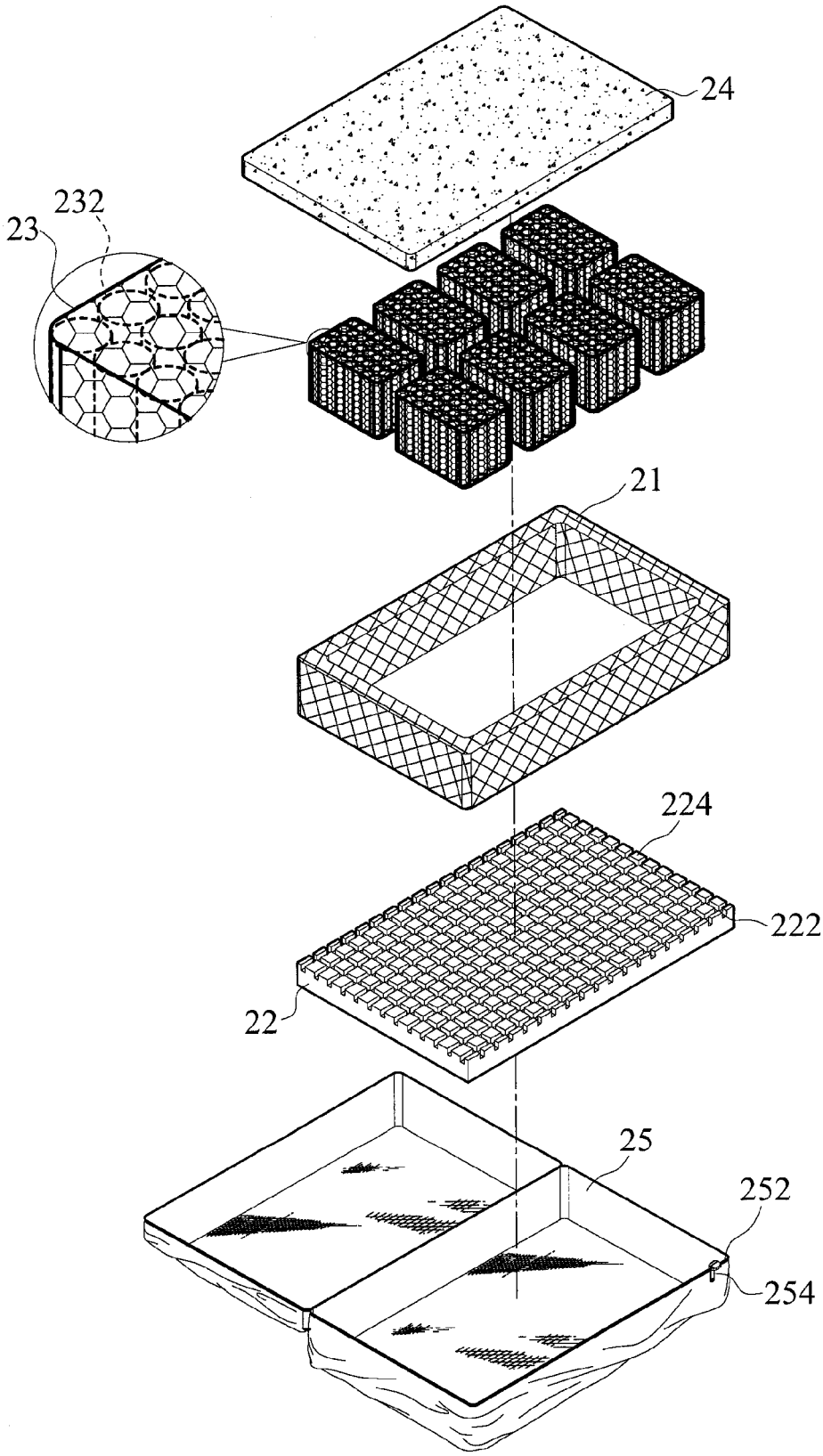
FIG. 3 is an exploded view of a preferred embodiment of the present invention.

With reference to FIGS. 2 and 3 for a cross-sectional view and an exploded view of a preferred embodiment of the present invention respectively, a multi-combinational spring mattress 2 of the invention comprises: a frame portion 21, a bottom layer 22, a plurality of spring layers 23, a surface layer 24 and a wrapping cover 25. This preferred embodiment allows users to swap or adjust each lying position of the spring layers 23 of the multi-combinational spring mattress 2 freely according to the user requirements and improves the applicability and compliance with various requirements by using different elasticity coefficients. In the structural design, the frame portion 21 is comprised of four sidewalls, and a containing space is enclosed at the middle of the four sidewalls, and the frame portion 21 becomes four lateral sides of the multi-combinational spring mattress 2. In other words, the spring layers 23 are placed in the containing space defined by the frame portion 21. The spring layers 23 are composed of a plurality of individual spring cylinders 232. The spring layers 23 are placed independently in the containing space, so that if one of the spring layers 23 becomes damaged or elastically fatigue, it is necessary to replace the spring layer 23 instead of replacing the entire spring mattress 2. To achieve the effect of meeting the requirements for different pressures, the spring mattress 2 has the spring layers 23 with different elasticity coefficients, and the spring layers 23 can be distinguished by different colored individual spring cylinders 232 quickly and conveniently. After the spring layers 23 are placed in the containing space, the bottom layer 22 is disposed at the bottom of the frame portion 21 (or the spring layers 23 are disposed at the top of the bottom layer 22) to prevent the spring layers 23 from sliding or displacing. The bottom layer 22 includes a plurality of linear ditches 222 longitudinally and latitudinally intersect at the top of the bottom layer 22 and a plurality of lumps 224 formed among the ditches 222, wherein the lumps 224 are made of latex, foam, or an equivalent material. After the spring layers 23 are placed on the bottom layer 22 and a pressure is exerted onto the lumps 224 of the bottom layer 22, the lumps 224 will be deformed in a direction towards the ditches 222 by the pressure to provide a shock absorbing effect, so as to reduce any displacement or slide after the spring layers 23 are pressed by the pressure.

After the spring layers 23 are placed in the containing space, a sleeper is not lying on the spring layers 23 directly, but the sleeper is lying on the surface layer 24 disposed at the top of the spring layers 23. The surface layer 24 is made of a material selected from silicone, latex, down, wool, silk or pressure relief foam. Finally, the wrapping cover 25 is provided for wrapping the frame portion 21, the bottom layer 22, the spring layers 23 and the surface layer 24 completely therein. The wrapping cover 25 further includes an open portion 252 disposed around the periphery of the top of the wrapping cover 25, and other components of the multi-combinational spring mattress 2 can be installed in the wrapping cover 25. An engaging structure 254 is installed at the open portion 252 for sealing the wrapping cover 25, wherein the engaging structure 254 can be a zipper, a button, or a Velcro tape.

Figure 4:
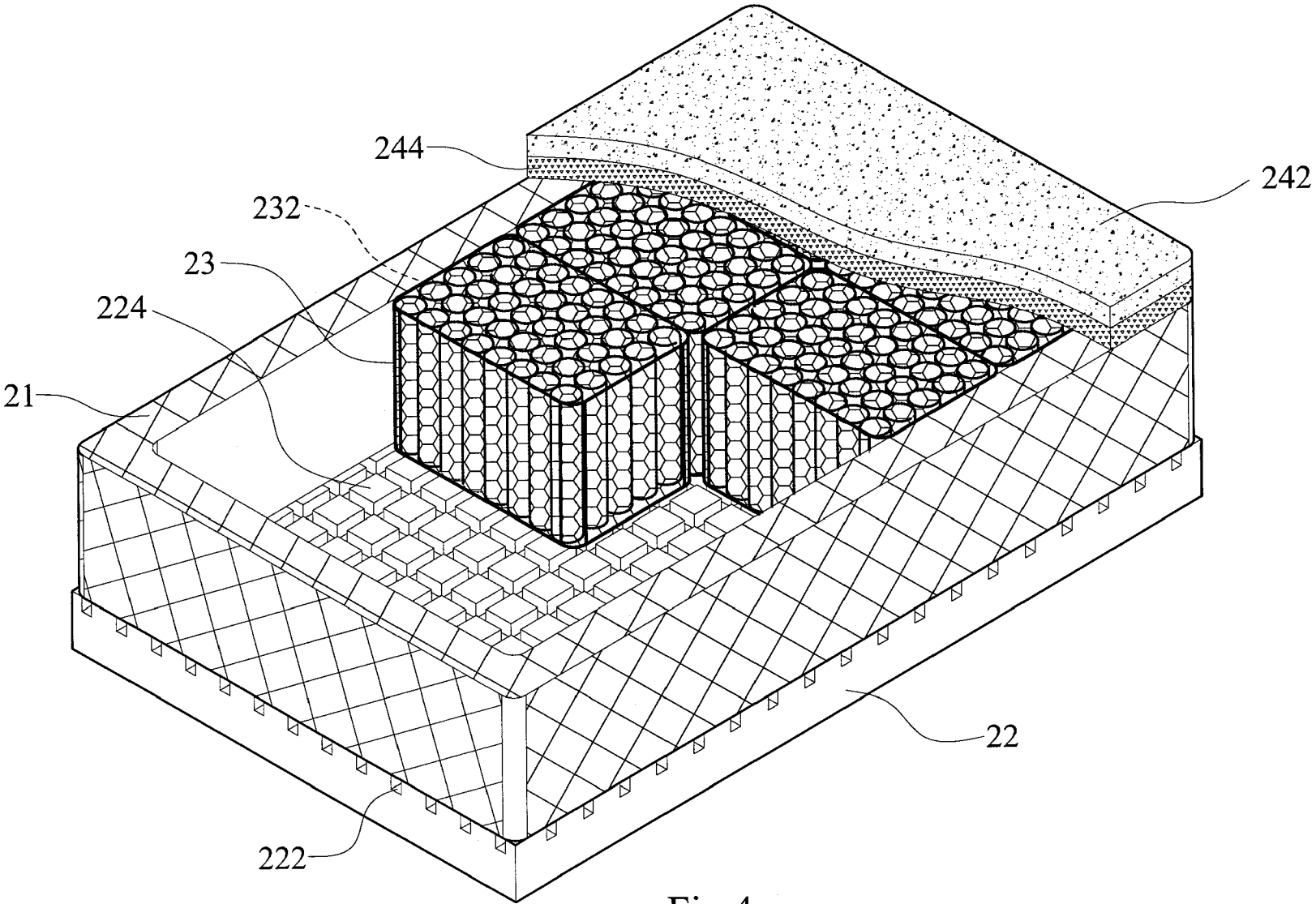
FIG. 4 is a cross-sectional view of another preferred embodiment of the present invention.

With reference to FIG. 4 for a cross-sectional view of another preferred embodiment of the present invention, this embodiment and the previous embodiment have substantially the same structure, except that the surface layer 24 of this embodiment further comprises a first surface layer 242 and a second surface layer 244, such that when the surface layer 24 is installed, the first surface layer 242 is disposed at the top of the second surface layer 244, and the first surface layer 242 is made of a material selected from down, wool, silk or pressure relief foam, and the second surface layer 244 is made of latex. Since the latex material provides good supports but poor ventilations and sweat volatility, and the down, wool, silk or pressure relief foam material is a soft, ventilating, sweat-volatile and thermal insulating material, therefore the design of the multi-combinational surface layer 24 can take care of the requirements of various different functions concurrently and can provide a more convenient way of changing the spring layers and a better compliance with the clean and environmental protection requirements.

The present invention provides an installable/removable spring mattress structure with a special bottom layer for positioning spring layers to improve the stability and ventilation of the spring mattress. The invention also adopts a plurality of spring layers with different elasticity coefficients, so that a user can combine and swap the spring layers according to the user's requirements and adjust the spring layers of different elasticity coefficients according to different parts of the user's body when the user is lying in bed. The invention also provides an easy way of changing a damaged or elastically fatigue spring layer or a dirty surface layer. In the meantime, the engaging structure (such as a zipper, a button or a Velcro tape) is installed at the open portion around the periphery of the wrapping cover to replace the conventional sewing method of fixing the wrapping cover, and provide an easy way of replacing a dirty or damaged surface layer, bottom layer or spring layer of the spring mattress.

While the invention has been described by device of specific embodiments, numerous modifications and variations could be made thereto by those generally skilled in the art without departing from the scope and spirit of the invention set forth in the claims.

What is claimed is:

1. A multi-combinational spring mattress, comprising:

a frame portion, for enclosing and defining a containing space;

a bottom layer, having a plurality of linear ditches longitudinally and latitudinally intersected at the top of the bottom layer, and a plurality of lumps formed among the ditches, and the bottom layer being disposed at the bottom of the containing space;

a plurality of spring layers, each having a plurality of individual spring cylinders, and stacked onto the top of the bottom layer;

a surface layer, stacked onto the top of the spring layers; and a wrapping cover, for wrapping the frame portion, the bottom layer, the spring layers and the surface layer completely therein.

2. The multi-combinational spring mattress of claim 1, wherein the spring layers have different elasticity coefficients.

3. The multi-combinational spring mattress of claim 2, wherein the wrapping cover further includes an open portion disposed around the periphery of the top of the wrapping cover, and an engaging structure installed at the open portion.

4. The multi-combinational spring mattress of claim 3, wherein the engaging structure is one selected from the collection of a zipper, a button and a Velcro tape.

* * * * *